US006174248B1

(12) United States Patent
Lawlor et al.

(10) Patent No.: US 6,174,248 B1
(45) Date of Patent: Jan. 16, 2001

(54) HOCKEY STICK TRAINING DEVICE

(75) Inventors: Robert W. Lawlor, Toronto; Steve Davidson, Bala; Scott Vickers, Schomberg, all of (CA)

(73) Assignee: Puckhandler Inc., Bala (CA)

( * ) Notice: Under 35 U.S.C. 154(b), the term of this patent shall be extended for 0 days.

(21) Appl. No.: 09/224,127

(22) Filed: Dec. 22, 1998

(51) Int. Cl.[7] ..... A63B 59/14
(52) U.S. Cl. ..... 473/446; 473/563
(58) Field of Search ..... 473/446, 560–563, 473/437

(56) References Cited

U.S. PATENT DOCUMENTS 3,834,697 * 9/1974 McNamara, Jr. et al. ..... 473/437
4,361,325 11/1982 Jansen ..... 273/67
4,364,560 * 12/1982 Gemmel ..... 473/437
4,653,753 3/1987 Scarry ..... 273/67
5,470,067 * 11/1995 Diresta ..... 473/446
5,484,146 * 1/1996 Loschiavo ..... 473/437
5,520,386 * 5/1996 Sasko ..... 473/437

FOREIGN PATENT DOCUMENTS

936553 * 11/1973 (CA) ..... 473/FOR 189

* cited by examiner

*Primary Examiner*—Mark S. Graham
(74) *Attorney, Agent, or Firm*—Connolly Bove Lodge & Hutz LLP

(57) ABSTRACT

A hockey stick training device to be attached to the shaft of a hockey stick includes a shield and a connector. The shield blocks a player's view of most of the blade of the hockey stick when the player carries the hockey stick forcing the player to rely on feel to handle and/or shoot rather than by sight.

31 Claims, 7 Drawing Sheets

HOCKEY STICK TRAINING DEVICE

FIELD OF THE INVENTION

The present invention relates to training devices and in particular to a hockey stick training device.

BACKGROUND OF THE INVENTION

In many sports such as ice hockey, ball hockey and field hockey, a player is required to control a puck, ball or the like with the blade of a stick. During game play or practice, it is desired that players keep their heads up and control the puck, ball or the like with the stick by feel rather than sight primarily for two reasons. One reason is that many of these sports are contact sports. If a player plays with their head up, the likelihood of an injury resulting from an unforeseen collision is substantially reduced. Also, by keeping their head up, a player is better able to see a developing play allowing the puck, ball or the like to be passed or shot to the most appropriate player or location.

Unfortunately, at many levels, players are not taught to play with their heads up even though a player who learns to do so will play at a higher level and will reduce the chance of injury. To deal with the above-identified problem and to instil in a player's mind that their head should be kept up during game play or practice, hockey training tools have been developed. For example, U.S. Pat. No. 4,022,466 to Kaiser discloses a hockey helmet attachment to obstruct the downward vision of a hockey helmet wearer. The attachment is in the form of a flat arcuate member formed of flexible opaque material. The arcuate member is attached to the helmet so that it extends forwardly of the helmet in a generally horizontal plane and below the eye opening of the helmet.

U.S. Pat. No. 4,653,753 to Scarry discloses a hockey stick training device to be attached to the shaft of the hockey stick intermediate the handle and the blade to obscure the blade from vision. The hockey stick training device includes a planar rectangular, opaque member to obscure the entire hockey stick blade from vision. A connector to secure the hockey stick training device to the shaft extends upwardly from the rectangular member and is integrally formed therewith.

Although the Scarry patent discloses a hockey stick training device to be attached to the shaft of a hockey stick to teach a player to play hockey with their head up, problems exist. In particular, the configuration and dimensions of the planar rectangular member adversely affect the weight and balance of the hockey stick to which the hockey stick training device is attached. Also, the connector used to attach the hockey stick training device to the hockey stick shaft has been found to be unsatisfactory resulting in movement of the hockey stick training device along the hockey stick shaft during use. Accordingly, an improved hockey stick training device is desired.

It is therefore an object of the present invention to provide a novel hockey stick training device.

SUMMARY OF THE INVENTION

According to one aspect of the present invention there is provided a hockey stick training device to be attached to the shaft of a hockey stick adjacent the blade thereof comprising:

- a connector to attach releasably said training device to said shaft;
- a shield extending from said connector to block a player's view of a portion of said blade; and

- a spacer to space said shield above said blade.

In a preferred embodiment, the connector and the shield are integrally formed. The connector depends from the shield and includes a lower edge to bear against a portion of the hockey stick and inhibit downward movement of the hockey stick training device along the shaft when the hockey stick device is subjected to centrifugal forces during use thereby to space the shield above the blade and constitute the spacer. The connector and the shield form an acute angle such that in use, the shield angles towards the blade and forms an angle with the horizontal in the range of from about 20 to 30 degrees.

Preferably, the connector includes a connecting flange defining a tube to surround and accommodate a portion of the shaft. A passage is provided in a wall of the connecting flange through which the shaft can pass. It is preferred that the passage widens at its ends. The connecting flange acts as a handle for grasping when the hockey stick training device is being placed on the shaft and removed from the shaft. The connecting flange includes spaced grooves on its sidewalls to provide corrugated surfaces that facilitate gripping. A strap of hook and loop fabric is threaded through a loop on the connector and is windable around the connecting flange and over itself to engage the hook and loop fabric.

According to another aspect of the present invention there is provided a hockey stick training device to be attached to the shaft of a hockey stick adjacent the blade thereof comprising:

- a connector to attach releasably said hockey stick training device to said shaft; and
- a shield extending from said connector over said blade to block a player's view of a portion of said blade, said shield being shaped and dimensioned to obscure at least the heel to about the midpoint of said blade while exposing the tip thereof.

According to still yet another aspect of the present invention there is provided a hockey stick training device to be attached to the shaft of a hockey stick adjacent the blade thereof comprising:

- a connector to attach releasably said hockey stick training device to said shaft; and
- a shield extending from said connector over said blade to block a player's view of a portion of said blade, said connector depending from one end of said shield and being integrally formed therewith, said connector including a connecting flange defining a tube to surround and accommodate a portion of said shaft, a wall of said connecting flange having a passage therein, said passage widening at its ends to facilitate opening of said passage as said shaft passes therethrough.

The present invention provides advantages in that the configuration and dimensions of the hockey stick training device are selected to inhibit the weight and balance of the hockey stick from being adversely affected when the hockey stick training device is attached to the shaft of the hockey stick. The configuration and dimensions of the hockey stick training device are also selected to obscure at least the heel to the midpoint of the hockey stick blade while keeping the tip of the hockey stick blade visible to the player holding the hockey stick. By keeping the tip of the hockey stick blade visible, a player is better able to set up to receive a puck while ensuring the puck is obscured by the hockey stick training device when the player handles or shoots the puck.

In addition, the present invention provides advantages in that the hockey stick training device can be easily attached to and removed from the hockey stick shaft. When the hockey stick training device is attached to the hockey stick shaft, it is held securely in place inhibiting the hockey stick training device from moving along the hockey stick shaft during use. Furthermore, the provision of the spacer allows the hockey stick training device to be positioned at basically the same position on virtually all hockey sticks thereby providing consistency during use.

BRIEF DESCRIPTION OF THE DRAWINGS

An embodiment of the present invention will now be described more fully with reference to the accompanying drawings in which.

DESCRIPTION OF THE PREFERRED EMBODIMENT

Figure 1:
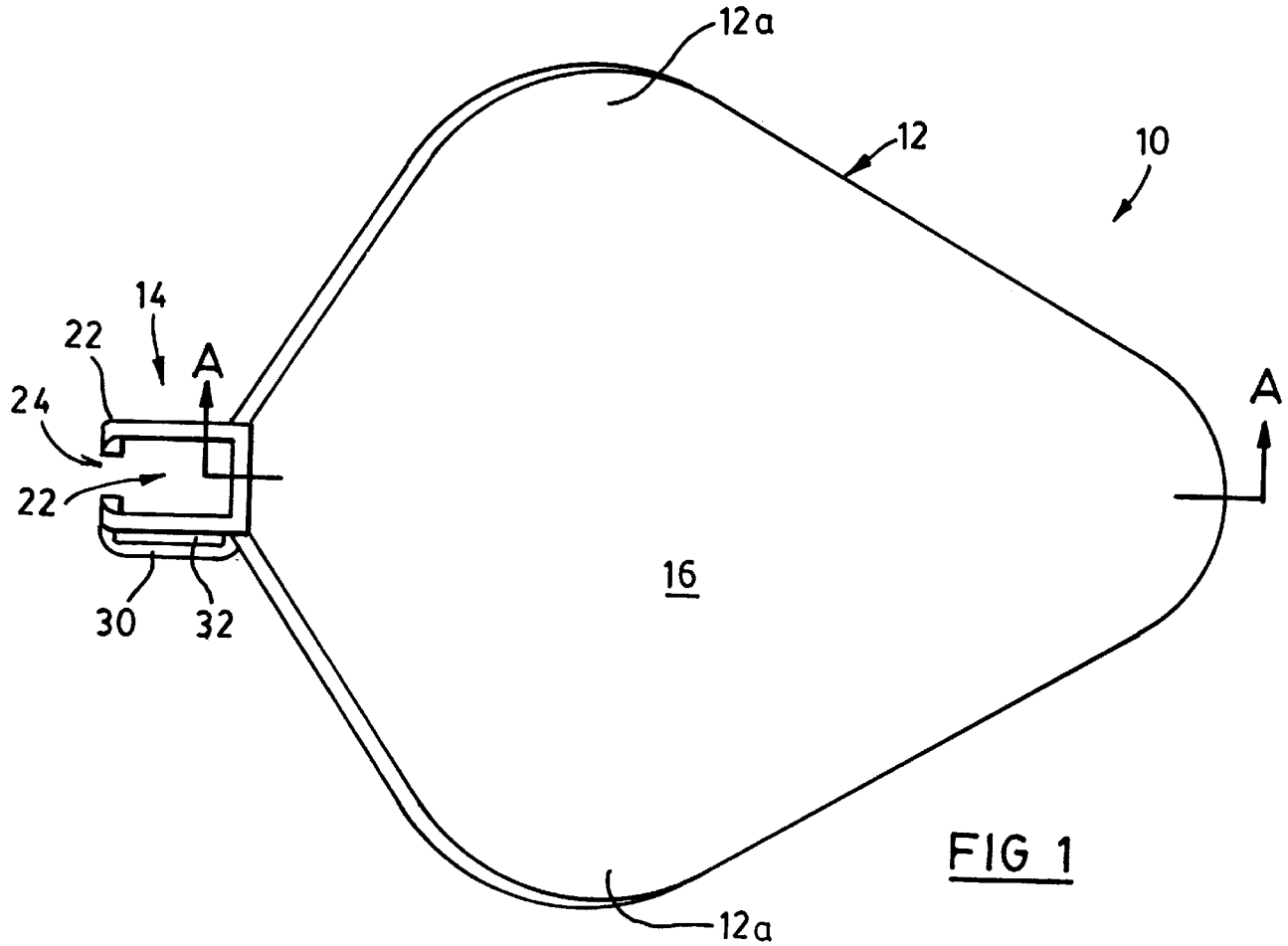
FIG. 1 is a top plan view of a hockey stick training device in accordance with the present invention.
Figure 2:
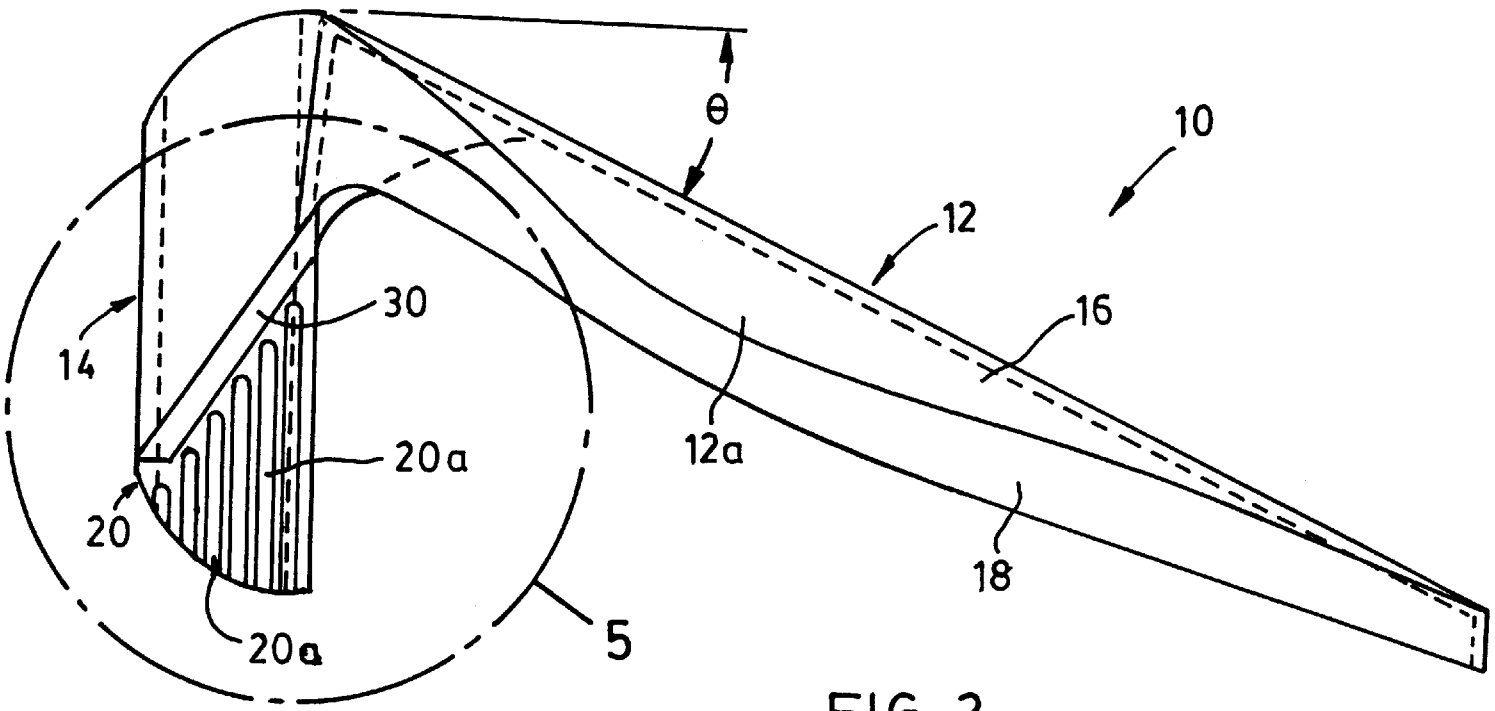
FIG. 2 is a side elevational view of the hockey stick training device of FIG. 1.
Figure 3:
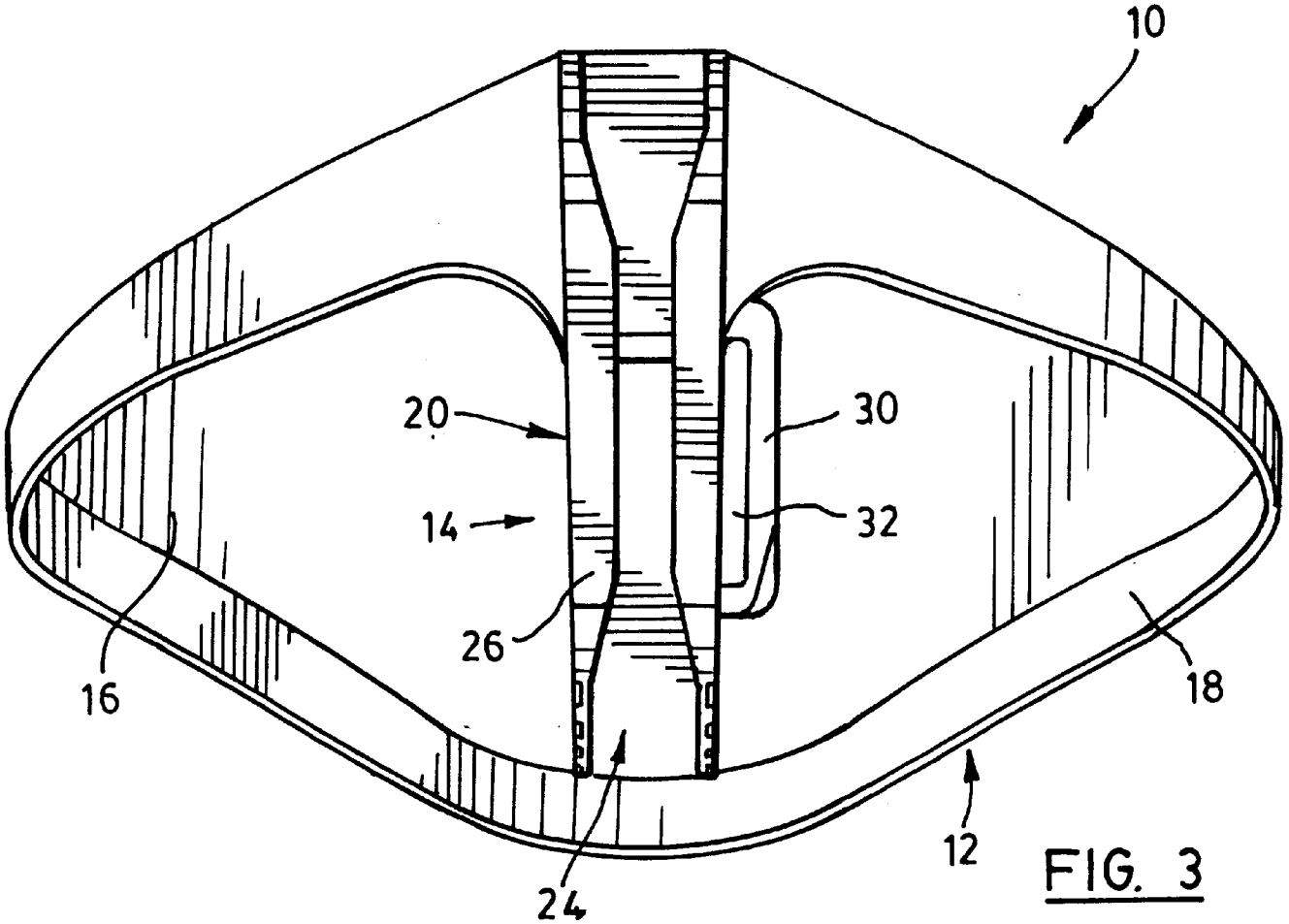
FIG. 3 is a rear elevational view of the hockey stick training device of FIG. 1.
Figure 4:
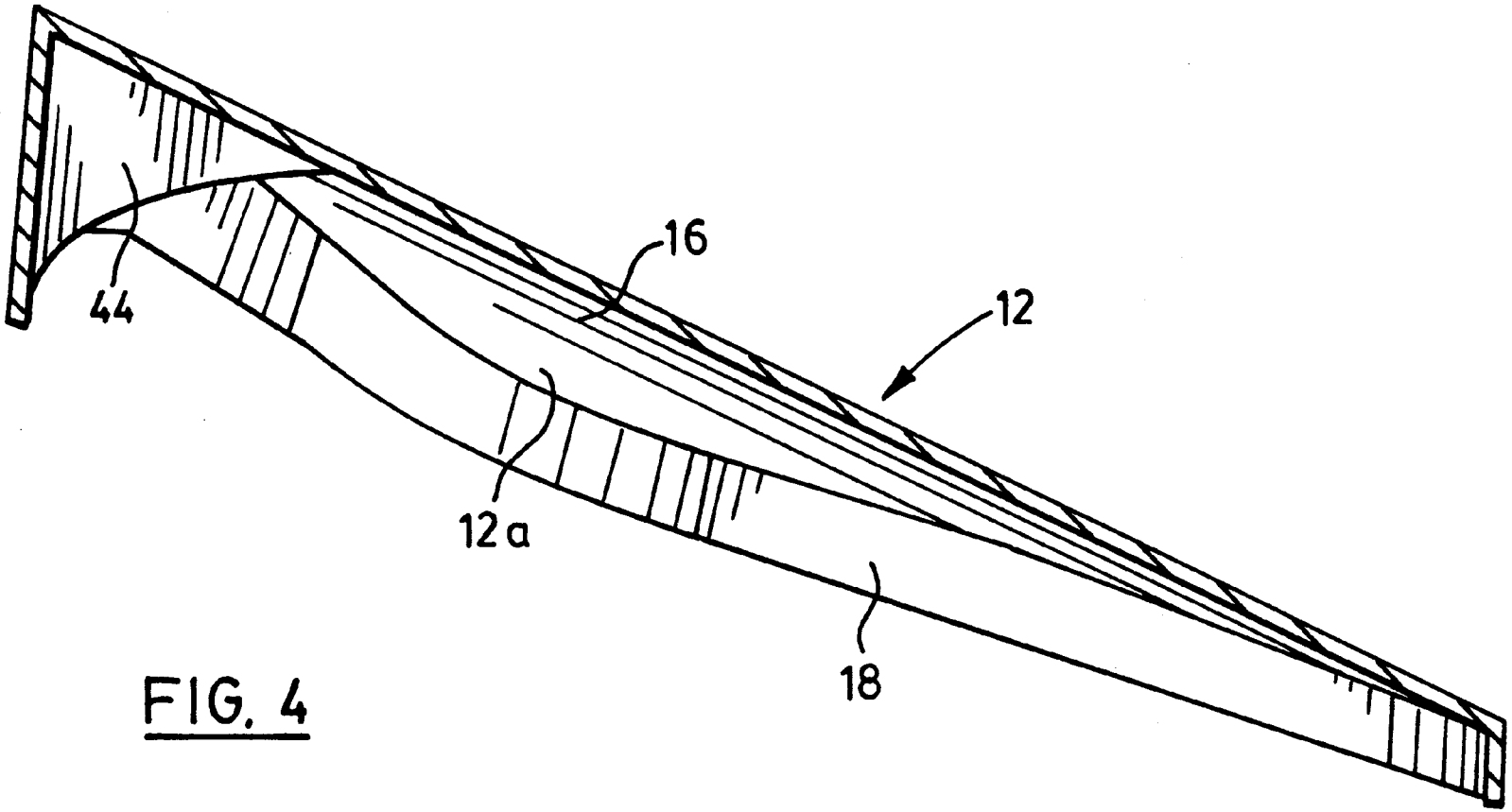
FIG. 4 is a cross-sectional view of the hockey stick training device of FIG. 1 taken along line A—A.
Figure 6:
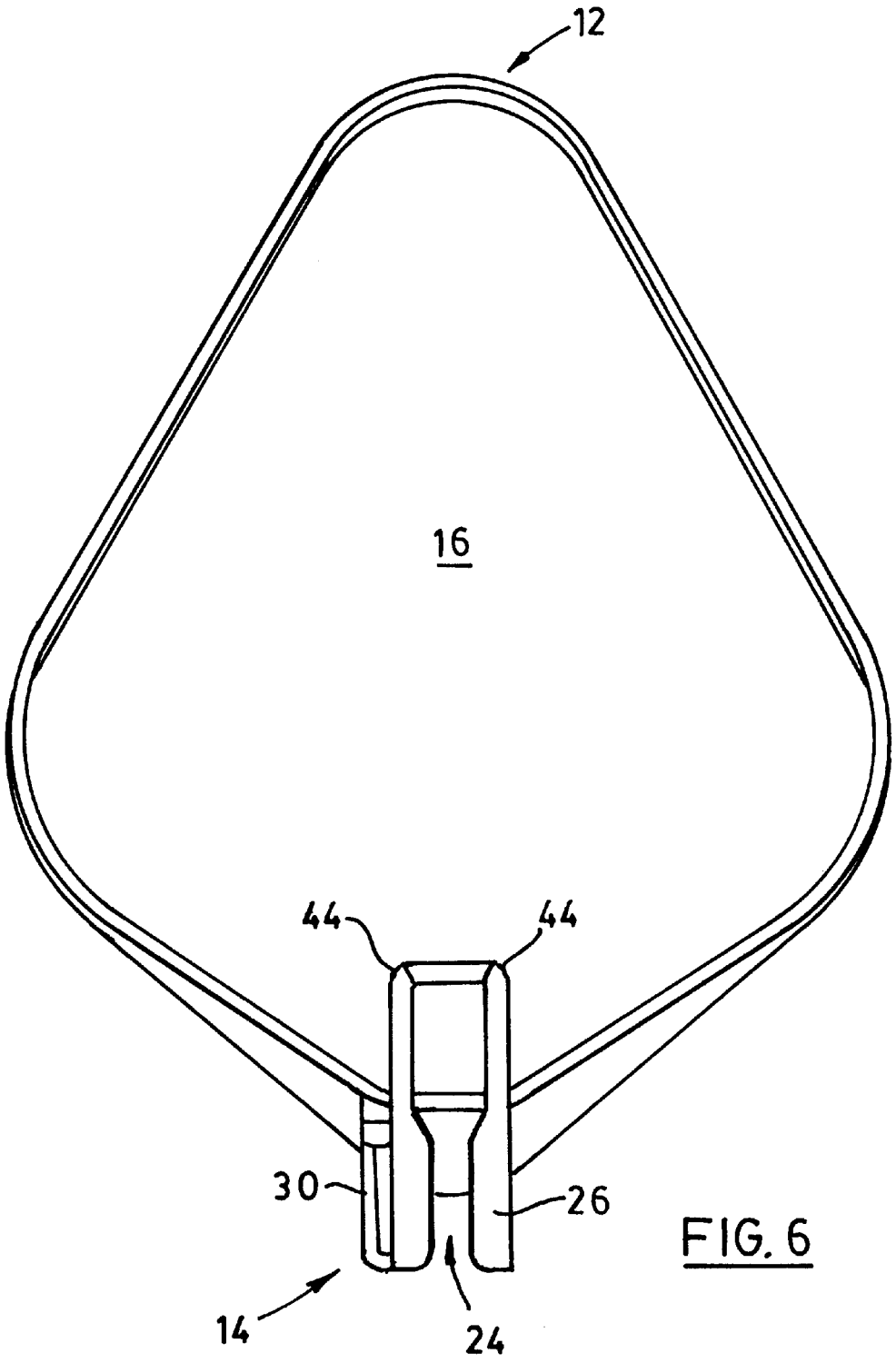
FIG. 6 is a bottom plan view of the hockey stick training device of FIG. 1.
Figure 7:
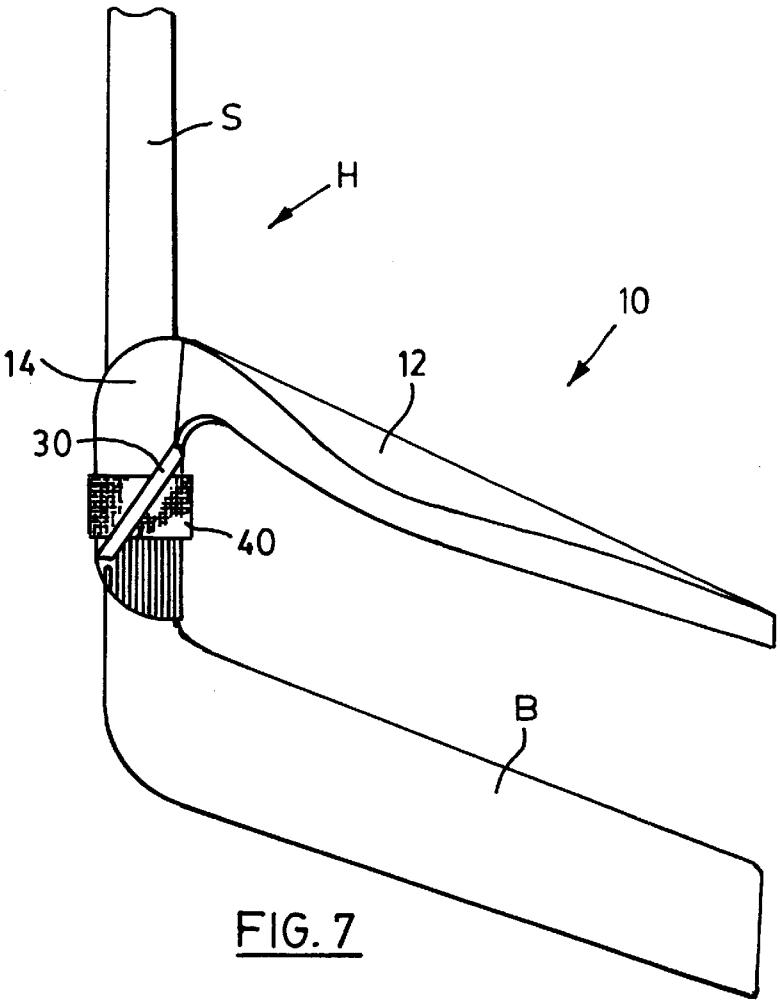
FIG. 7 is a side elevational view of the hockey stick training device of FIG. 1 attached to a hockey stick.
Figure 5:
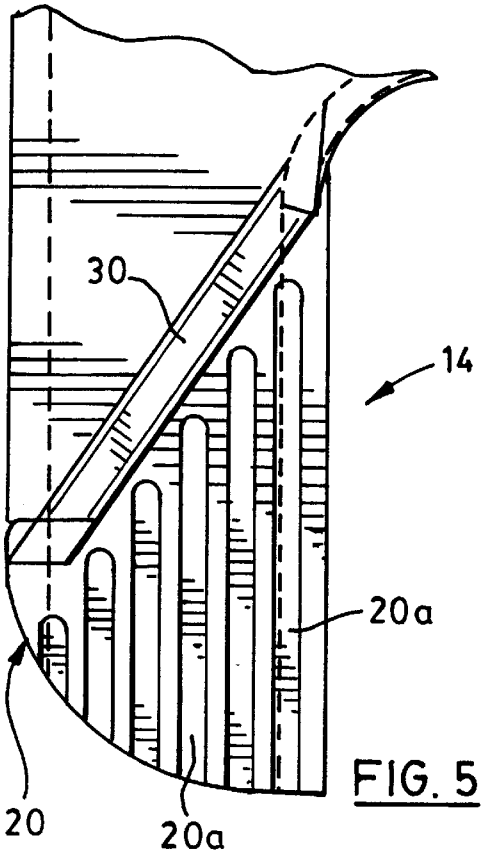
FIG. 5 is an enlarged side elevational view of a portion of the hockey stick training device of FIG. 1.

Referring now to FIGS. 1 to 7, a hockey stick training device in accordance with the present invention is shown and is generally indicated to by reference numeral 10. The hockey stick training device 10 is designed to be attached to the shaft S of a hockey stick H adjacent the hockey stick blade B (see FIG. 7). The hockey stick training 10 device is designed to obscure from vision, most of the hockey stick blade to force a player holding the hockey stick H to handle and shoot a puck by feel rather than by sight. In this manner, the hockey stick training device 10 teaches a player to handle and shoot a puck while keeping their head up during game play. Specifics of the hockey stick training device 10 will now be described.

The hockey stick training device 10 is preferably formed of flexible, opaque plastic material and includes a shield 12 to overlie a hockey stick blade and obscure most of the hockey stick blade from vision. A connector 14 depends from one end of the shield 12 to allow the hockey stick training device to be attached to the shaft of the hockey stick. The shield 12 and the connector 14 form an acute angle such that when the hockey stick training device 10 is properly positioned on the shaft of a hockey stick, the shield forms an angle θ with the horizontal in the range of from about 20 to 30 degrees.

As can be seen in FIGS. 1 to 4 and 6, the shield 12 is generally delta-shaped in top plan defining a pair of wings 12*a*. The shield 12 includes a top member 16 and a peripheral skirt 18 depending from the top member 16. The corners of the shield 12 are rounded and the peripheral edges of the top member 16 and skirt 18 are bevelled so that no sharp edges are exposed. The shield 12 is dimensioned and shaped to conceal the portion of the hockey stick blade most often used to carry or shoot a puck (i.e. the portion of the blade extending from the heel of the hockey stick to midway along the length of the blade) while keeping the tip of the hockey stick blade visible. Specifically, the wings 12*a* are offset from the midpoint of the shield 12 so that the shield is wider near the heel of the hockey stick. The wings 12*a* also curve downwardly toward to hockey stick blade. The lengthwise dimension of the shield 12 in the present embodiment is selected so that approximately one (1) inch of the hockey stick blade remains visible to a player holding the hockey stick.

The connector 14, best shown in FIGS. 1 to 3 and 5, includes a connecting flange 20 integrally formed with the shield 12 and defining a rectangular tube 22 to accommodate the shaft of the hockey stick. The connecting flange 20 functions as a holder as will be described and has spaced grooves 20*a* formed in its sidewalls to provide corrugated surfaces that facilitate grasping. A passage 24 is formed in the rear wall 26 of the connecting flange 20 and extends along its length to provide an opening in the tube 22. Opposite ends of the passage 24 are V-shaped defining widened end portions. A strap holder 30 is integrally formed on one of the connecting flange sidewalls. The strap holder 30 is generally U-shaped to define a gap 32 between its bight and the connecting flange sidewall. A strap 40 formed of hook and loop type fabric and having a buckle 42 at one end (see FIG. 8*b*) passes through the gap 32 and can be wrapped around the connecting flange 20 and over the strap holder 30. The connecting flange 20 has a lengthwise dimension equal to about 5 inches. This length has been found to be sufficient to space properly the shield 12 above the hockey stick blade as well as to accommodate the strap holder 30 and the strap 40 while keeping the amount of material required to form the hockey stick training device 10 within an acceptable range. As will be appreciated, extra material increases manufacturing costs as well as increases the weight of the hockey stick training device 10 which may adversely affect the balance of the hockey stick during use.

A pair of spaced triangular ribs 44 is provided on the undersurface of the shield 12 to enhance the structural rigidity of the shield 12. The ribs 44 extend from the connecting flange 20 and terminate intermediate the shield length.

Figure 8B:
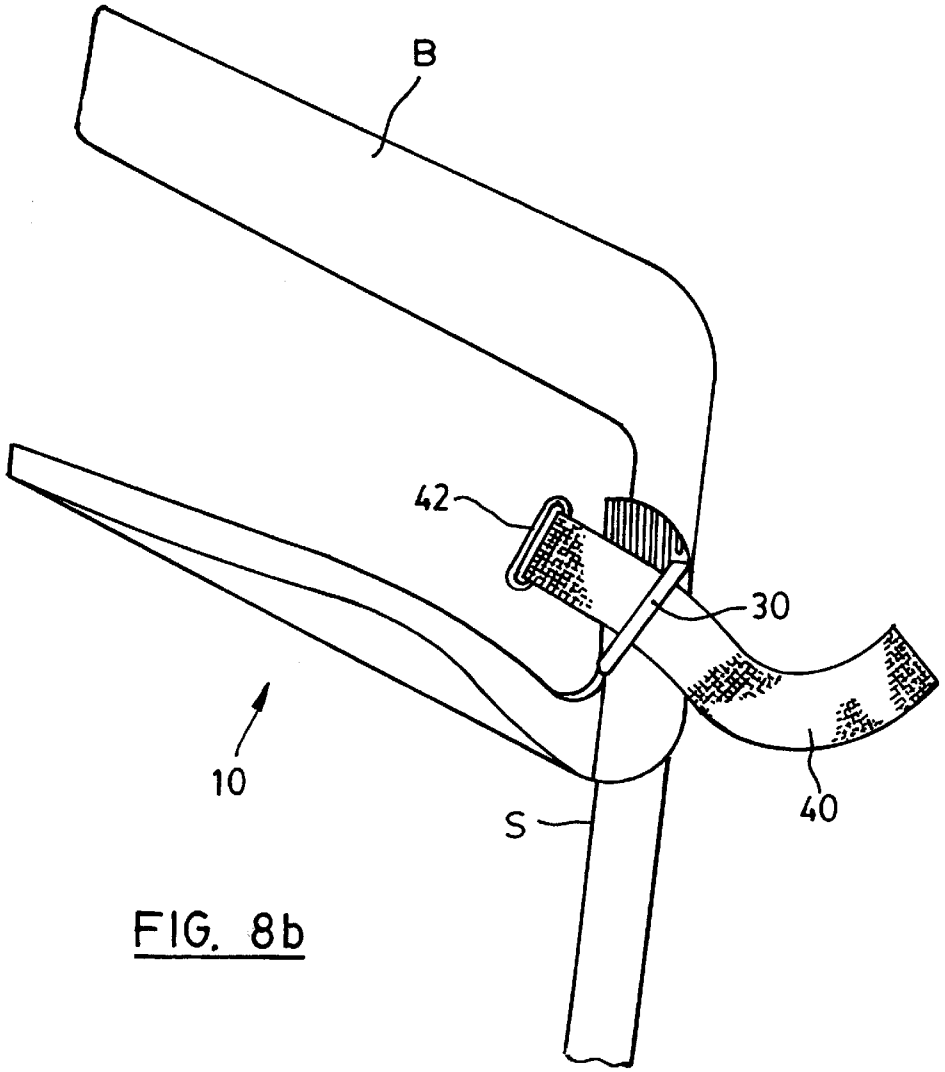
FIGS. 8*a* and 8*b* are side elevational views showing the hockey stick training device of FIG. 1 being attached to a hockey stick.
Figure 8A:
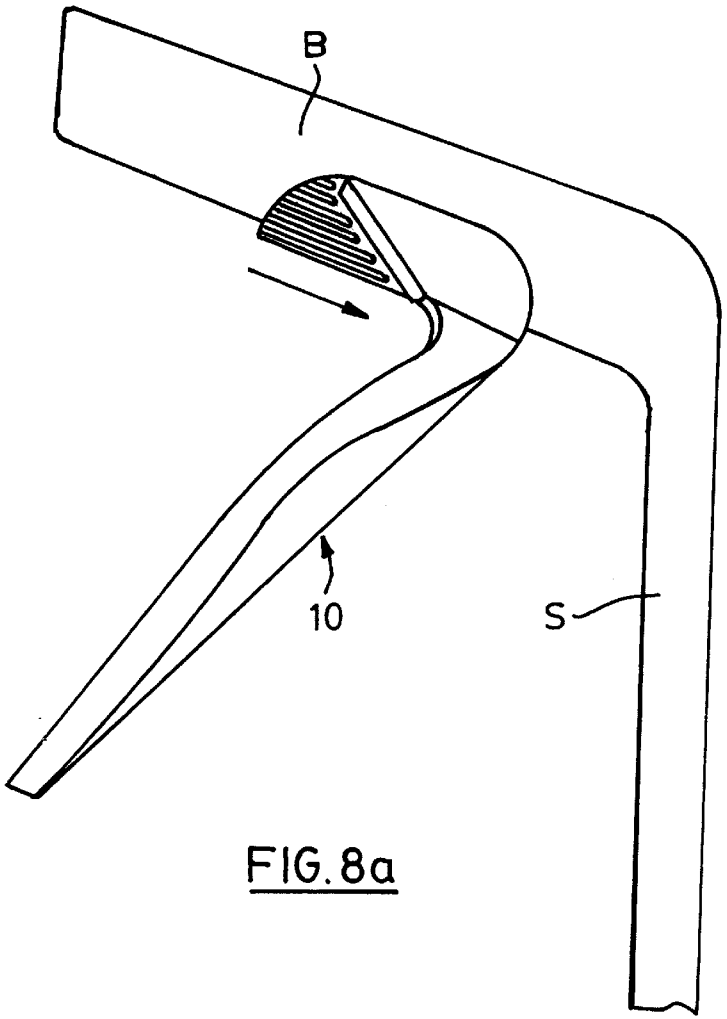

Turning now to FIGS. 8*a* and 8*b*, the manner in which the hockey stick training device 10 is attached to the shaft of a hockey stick will now be described. To attach the hockey stick training device to the shaft of the hockey stick, the hockey stick H is held upside-down by the player. The hockey stick training device 10 is then grasped by the connecting flange 20, which acts as a holder, so that the hockey stick training device is also upside-down with the shield 12 bearing against the player's arm. The V-shaped end of the passage 24 nearest the shield 12 is then placed over the hockey stick blade B generally at the point where the hockey stick blade curves to join the shaft S. With the hockey stick training device 10 being pushed towards the hockey stick blade, the hockey stick training device is slid along the hockey stick blade towards the shaft S. By sliding the hockey stick training device around the curved portion of the hockey stick blade, the passage 24 opens up to accommodate the wider shaft. When the shaft is surrounded by the connecting flange 20 with the lower edge of the connecting flange at the point where the shaft curves toward the blade, the free end of the strap 40 is threaded through the buckle 42. The strap 40 is then pulled back and wound around the connecting flange 20 and the strap holder 30 before being secured to itself. The hockey stick training device 10 is then ready for use. If the connecting flange 20 is loose, tape can be wrapped around the hockey stick shaft about 4 inches above the blade to provide a secure fit between the connecting flange and hockey stick shaft.

With the hockey stick training device 10 secured to the hockey stick, a player can learn to control the puck by feel and therefore, learn to play with their head up. Since the tip of the hockey stick blade remains visible, the player is better able to set up to receive a puck even though the puck will be obscured once carried using the hockey stick. Contact between the lower edge of the connecting flange 20 and the curved portion of the shaft inhibits further downward movement of the hockey stick training device 10 when the hockey stick training device is subjected to centrifugal forces during use. Thus, the connecting flange 20 acts as a spacer to position properly the shield 12 above the hockey stick blade. As a result, the hockey stick training device 10 is basically positioned at the same place relative to the hockey stick blade regardless of the hockey stick type thereby ensuring consistency during use.

To remove the hockey stick training device, the strap 40 is unattached from itself and is unwound from the connecting flange 20. The free end of the strap 40 is then removed from the buckle 42. After the strap 40 has been freed, the hockey stick training device 10 is removed from the hockey stick by reversing the process used to attach the hockey stick training device to the hockey stick described above. Thus, the connecting flange 20 is grasped with the hockey stick upside-down and the hockey stick training device 10 is slid down the shaft along the curved portion towards the blade while pulling the hockey stick training device away from the hockey stick. The V-shaped end of the passage 24 furthest from the shield 12 opens allowing the hockey stick to pass through the passage removing it from the connecting flange 20. As will be appreciated, during placing and removing of the hockey stick training device 10 on and from the hockey stick, the widened V-shaped end portions of the passage 24 facilitate opening of the passage as the hockey stick shaft passes through the passage during installation and removal. This of course makes it easier to place the hockey stick training device 10 on the hockey stick shaft and subsequently remove the hockey stick training device from the hockey stick shaft.

As will be appreciated, the hockey stick training device 10 can be easily attached to and removed from a hockey stick allowing players of virtually all ages to use the hockey stick training device. Its design does not adversely affect the weight and balance of the hockey stick to which the hockey stick training device is attached and is sufficiently strong to withstand forces applied to it during use. Also, because the connecting flange 20 spaces the shield 12 above the hockey stick blade at a desired height, the desired portion of the hockey stick blade is obscured from the player's vision generally regardless of the type of hockey stick to which the hockey stick training device is attached.

It will also be appreciated by those of skill in the art that modifications and variations may be made to the present invention without departing from the spirit and scope thereof as defined by the appended claims.

We claim:

1. A hockey stick training device to be attached to the shaft of a hockey stick adjacent the blade thereof comprising:

a connector adapted to attach releasably said hockey stick training device to said shaft;

a shield extending from said connector to block a player's view of at least a portion of said blade; and a spacer to space said shield above said blade, wherein said connector and shield are integrally formed, said connector depending from said shield and including a lower edge to bear against a portion of said hockey stick and inhibit downward movement of said hockey stick training device along said shaft thereby to space said shield above said blade and constitute said spacer, said connector and shield forming an acute angle therebetween, such that in use, said shield angles towards said blade.

2. A hockey stick training device as defined in claim 1 wherein in use, said shield forms an angle with the horizontal in the range of from about 20 to 30 degrees.

3. A hockey stick training device as defined in claim 1 wherein said connector includes a connecting flange defining a tube to surround and accommodate a portion of said shaft, a wall of said connecting flange having a passage therein through which said shaft can pass.

4. A hockey stick training device as defined in claim 3 wherein said connecting flange acts as a handle for grasping when said hockey stick training device is being placed on said shaft and removed from said shaft, said connecting flange including spaced grooves on sidewalls thereof to facilitate gripping.

5. A hockey stick training device as defined in claim 3 wherein said passage widens at opposite ends thereof.

6. A hockey stick training device as defined in claim 3 wherein said connector further comprises strap means acting on said connecting flange to close said connecting flange around said shaft.

7. A hockey stick training device as defined in claim 6 wherein said strap means includes a strap of hook and loop fabric, said strap being threaded through a loop on said connector and being windable around said connecting flange and over itself to engage said hook and loop type fabric.

8. A hockey stick training device as defined in claim 1 wherein said shield is generally delta-shaped in plan and is dimensioned to obscure most of the blade of said hockey stick.

9. A hockey stick training device to be attached to the shaft of a hockey stick adjacent the blade thereof comprising:

a connector adapted to attach releasably said hockey stick training device to said shaft; and a shield extending from said connector over said blade to block a player's view of at least a portion of said blade, said shield being generally delta-shaped in plan and dimensioned to obscure at least the heel to about midpoint of said blade while exposing the tip thereof.

10. A hockey stick training device as defined in claim 9 wherein said connector and shield are integrally formed, said connector depending from said shield and including a lower edge to bear against a portion of said hockey stick and inhibit downward movement of said hockey stick training device along said shaft thereby to space said shield above said blade.

11. A hockey stick training device as defined in claim 10 wherein said connector and shield form an acute angle therebetween, such that in use said shield angles towards said blade.

12. A hockey stick training device as defined in claim 11 wherein in use, said shield forms an angle with the horizontal in the range of from about 20 to 30 degrees.

13. A hockey stick training device as defined in claim 10 wherein said connecting flange acts as a handle for grasping when said hockey stick training device is being placed on said shaft and removed from said shaft, said connecting flange including spaced grooves on sidewalls thereof to facilitate gripping.

14. A hockey stick training device to be attached to the shaft of a hockey stick adjacent the blade thereof comprising:

a connector adapted to attach releasably said hockey stick training device to said shaft; and a shield extending from said connector over said blade to block a player's view of at least a portion of said blade, said connector depending from one end of said shield and being integrally formed therewith, said connector defining a tube to surround and accommodate a portion of said shaft, a wall of said tube having a passage therein, said passage widening at opposite ends thereof to facilitate opening of said passage as said shaft passes therethrough.

15. A hockey stick training device as defined in claim 14 wherein said connector further comprises strap means acting on said tube to close said tube around said shaft.

16. A hockey stick training device as defined in claim 15 wherein said strap means includes a strap of hook and loop fabric, said strap being threaded through a loop on said connector and being windable around said tube and over itself to engage said hook and loop type fabric.

17. A hockey stick training device as defined in claim 16 wherein said tube includes a lower edge to bear against a portion of said hockey stick and inhibit downward movement of said hockey stick training device along said shaft thereby to space said shield above said blade.

18. A hockey stick training device as defined in claim 17 wherein said connector and shield form an acute angle therebetween, such that in use said shield angles towards said blade.

19. A hockey stick training device as defined in claim 18 wherein in use said shield forms an angle with the horizontal in the range of from about 20 to 30 degrees.

20. A hockey stick training device as defined in claim 14 wherein said tube acts as a handle for grasping when said hockey stick training device is being placed on said shaft and removed from said shaft, said tube including spaced grooves on sidewalls thereof to facilitate gripping.

21. A hockey stick training device to be attached to the shaft of a hockey stick adjacent the blade thereof comprising:

a connector adapted to attach releasably said hockey stick training device to said shaft, said connector defining a tube to surround and accommodate a portion of said shaft, a wall of said tube having a passage therein through which said shaft can pass, said connector including strap means to surround to said tube and said shaft and close said tube around said shaft; and a shield extending from said connector to block a player's view of at least a portion of said blade when said hockey stick training device is attached to said shaft.

22. A hockey stick training device as defined in claim 21 wherein said strap means includes a strap of hook and loop fabric, said strap being threaded through a loop on said connector and being windable around said tube and over itself to engage said hook and loop fabric.

23. A hockey stick training device as defined in claim 21 wherein said tube includes a lower edge to bear against a portion of said hockey stick and inhibit downward movement of said hockey stick training device along said shaft thereby to space said shield above said blade.

24. A hockey stick training device as defined in claim 23 wherein said tube acts as a handle for grasping when said hockey stick training device is placed on said shaft and removed from said shaft, said tube including spaced grooves on side walls thereof to facilitate gripping.

25. A hockey stick training device to be attached to the shaft of a hockey stick adjacent the blade thereof comprising:

a connector adapted to attach releasably said hockey stick training device to said shaft;

a shield extending from said connector to block a player's view of at least a portion of said blade; and a spacer to space said shield above said blade, wherein said shield is shaped to define a pair of wings and narrows at a distal end thereof to obscure most of the blade of said hockey stick from said player's view.

26. A hockey stick training device as defined in claim 25 wherein said connector and shield form an acute angle therebetween, such that in use, said shield angles towards said blade.

27. A hockey stick training device as defined in claim 26 wherein in use, said shield forms an angle with the horizontal in the range of from about 20 to 30 degrees.

28. A hockey stick training device to be attached to the shaft of a hockey stick adjacent the blade thereof comprising:

a connector adapted to attach releasably said hockey stick training device to said shaft; and a shield extending from said connector, said connector and shield forming an acute angle therebetween, whereby the shield angles towards said blade and the view of a portion of said blade from the end of said shaft is obscured when said hockey stick training device is attached to said shaft, said shield being shaped to define a pair of wings intermediate the length thereof and narrowing at a distal end adjacent the tip of said blade to maintain approximately one inch of said blade in said view.

29. A hockey stick training device as defined in claim 28 wherein said connector and shield form an angle therebetween, such that in use, said shield angles towards said blade.

30. A hockey stick training device as defined in claim 29 wherein in use, said shield forms an angle with the horizontal in the range of from about 20 to 30 degrees.

31. A hockey stick comprising:

a shaft having a handle at one end thereof and a blade at an opposite end thereof; and a hockey stick training device attached to said shaft adjacent said blade, said hockey stick training device including:

a connector releasably coupling said hockey stick training device to said shaft;

a shield extending from said connector and overlying said blade whereby the view of at least a portion of said blade from the one end of said handle is obscured; and a spacer to space said shield above said blade, said shield being shaped to define a pair of wings intermediate the length thereof and narrowing at a distal end adjacent the tip of said blade.

* * * * *